US006032339A

United States Patent [19]

D'Addario

[11] Patent Number: 6,032,339

[45] Date of Patent: Mar. 7, 2000

[54] LOCKING FASTENER FOR A STRAP

[75] Inventor: James D'Addario, Old Westbury, N.Y.

[73] Assignee: Innovative Automation, Inc., Farmingdale, N.Y.

[21] Appl. No.: 09/261,842

[22] Filed: Mar. 3, 1999

[51] Int. Cl.[7] ..... A44B 11/00; A44C 5/00

[52] U.S. Cl. ..... 24/649; 24/265 BC; 24/590; 24/591

[58] Field of Search ..... 24/649, 650, 590, 24/591, 301, 302, 265 WS, 265 BC

[56] References Cited

U.S. PATENT DOCUMENTS

| | | | |
|---|---|---|---|
| 689,991 | 12/1901 | Rubin | 24/649 |
| 703,878 | 7/1902 | Woodward | 24/265 BC |
| 705,641 | 7/1902 | Britnell | 24/649 |
| 828,573 | 8/1906 | Rubin | 24/649 |
| 2,647,294 | 8/1953 | Davis | 24/649 |
| 3,743,147 | 7/1973 | Wilczynski | 24/590 |
| 4,461,594 | 7/1984 | Waber . | |
| 4,556,133 | 12/1985 | Huber . | |
| 4,676,530 | 6/1987 | Nordgren et al. . | |
| 4,756,654 | 7/1988 | Clough . | |
| 4,767,246 | 8/1988 | Camloh et al. . | |
| 4,812,094 | 3/1989 | Grube . | |
| 5,193,368 | 3/1993 | Ling . | |
| 5,746,334 | 5/1998 | Brandenberg . | |
| 5,868,293 | 2/1999 | D'Addario et al. . | |

*Primary Examiner*—Victor N. Sakran
*Attorney, Agent, or Firm*—Hedman, Gibson & Costigan, P.C.

[57] ABSTRACT

A fastener for fastening a strap to an article having an end pin attached thereto, the fastener having a retention portion and an engagement portion defining a fastener aperture where movement of the engagement portion relative to the retention portion acts to close the fastener aperture about a reduced diameter portion of the end pin. A locking mechanism restricts movement of the engagement portion thereby maintaining the fastener aperture in its engagement position.

12 Claims, 4 Drawing Sheets

LOCKING FASTENER FOR A STRAP

FIELD OF THE INVENTION

The present invention relates to a fastener for fastening a strap to an article such as a musical instrument, luggage, etc.

BACKGROUND OF THE INVENTION

Straps have long been used to aid a user carrying or holding an object. Although straps are sometimes integral to the item being carried, i.e. sewn onto the object, often times the strap will be releasable to allow removal of the strap from the article.

Many methods of releasably attaching a strap are known, including clips, snaps, D-rings, belt buckles, and the like. Musical instruments, such as guitars, have used end pins attached to the instrument which are engaged by a leather (or synthetic) tab at the end of the strap. The leather tab has a keyhole and a cut where the cut is opened and placed over the end pin, the end pin then finding its way into the keyhole. At least some of the various end pins used on musical instruments are shown in FIG. 1 hereto.

Due to the wide variety of end pins in use, and the stiffness of new leather on the tab of known straps, it can be difficult to stretch the keyhole of the leather tab over the end pins. Conversely, as the leather wears and the keyhole stretches, the strap begins to go on and come off too easily. This can cause the keyhole to release the end pin and the instrument to fall during use or performance, especially if the user or performer moves about while carrying the article.

Instrument and luggage strap manufacturers have recently begun using quick release buckles on the straps so that the performer can quickly and easily remove the instrument. One example of this is seen in U.S. Pat. No. 5,868,293, incorporated by reference. However, the straps using these quick release mechanisms still have the leather tabs for engaging the end pins. Additionally, to place the instrument into a case, the end of the strap held on by the leather tabs still needed to be removed from the end pins.

It is therefore an object of the invention to provide a strap fastener which can adapt to a variety of end pins.

It is a further object to provide a strap fastener than can be quickly engaged and disengaged.

It is an additional object to provide a strap fastener which maintains a consistent secured position with an end pin.

SUMMARY OF THE INVENTION

These and other objects are achieved by the present invention directed to a fastener for securing a strap onto an article to be supported, said article having an end pin thereon including a reduced diameter portion and a larger diameter terminal portion, said fastener comprising a first member including a retention portion for receiving the end pin, said retention portion defining a first portion of a fastener aperture, and an engaging member having an engagement portion defining a second portion of the fastener aperture so that movement of the engagement portion relative to the retention portion defines the size of the fastener aperture.

In its preferred embodiment, the engaging member is a rotating disk with an aperture for receiving the end pin, the aperture being aligned with an aperture on the first member. The aperture of the engaging member comprises an eccentric aperture, the edge of which comprises the engaging portion for engaging the reduced diameter portion of the end pin. When the engaging member is rotated, the engagement portion moves in relation to the retention portion of the first member thereby adjusting the size of the fastener aperture.

The engaging member preferably has a locking element for retaining the engaging member in a selected position. It is also preferred that the engaging member is located within a housing to limit interference with moving parts and possible injury to the user.

The fastener is attached to the strap by any known means. Preferably, the strap is secured onto the fastener and the fastener is ultrasonically welded to create a permanent attachment. Another preferred attachment is the use of a loop passing through a slot in the fastener. The loop is preferably used when a length adjustment clip is provided on the strap.

BRIEF DESCRIPTION OF THE DRAWINGS

The attached drawings, in which like reference characters represent like parts, are intended to illustrate the preferred embodiment of the present invention without limiting the invention in any manner whatsoever, wherein.

DETAILED DESCRIPTION OF THE PREFERRED EMBODIMENT

Figure 1:
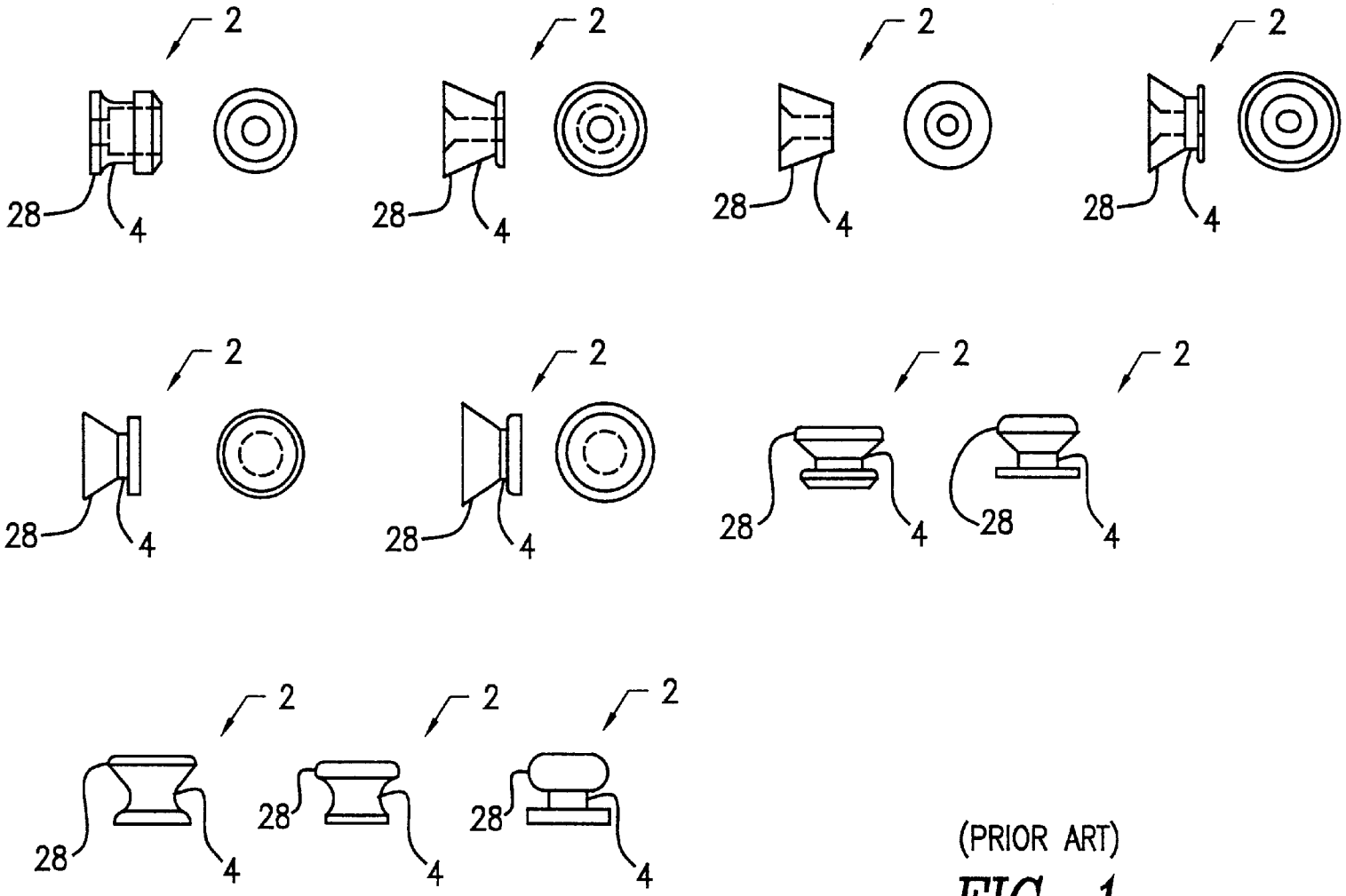
(PRIOR ART) FIG. 1
FIG. 1 is a sample of various end pins known in the art.
Figure 2:
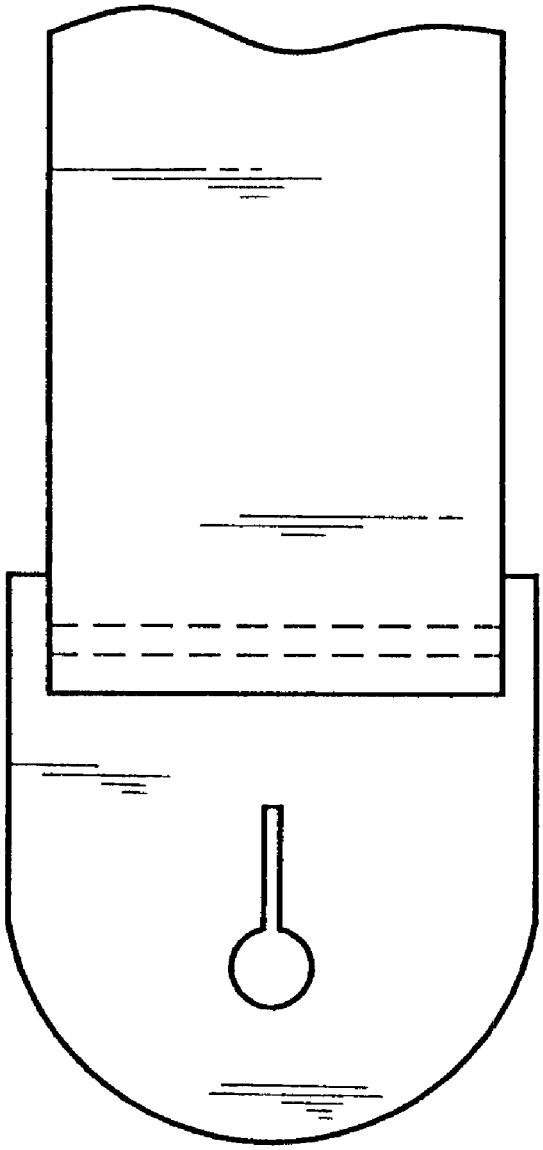
(PRIOR ART) FIG. 2
FIG. 2 is a plan view of the prior art strap fastener for musical instruments.

The fastener 6 of the present invention comprises a first member 8 having a retention portion 10 thereon for receiving the end pin 2 of an article and an engaging member 12 having an engagement portion 14 movable relative to the retention portion 10 for determining the size of a fastener aperture. The fastener aperture created by the retention portion 10 of the first member 8 and the engagement portion 14 of the engaging member 12 is placed over the terminal portion of the end pin 2 to about the reduced diameter portion 4 of the end pin 2 and the size of the fastener aperture is then reduced to its engagement position, about the size of the reduced diameter portion 4 of the end pin 2. A locking element 16 retains the engaging member 12 in its engagement position until the user releases it to remove the fastener 6 from the end pin 2. The fastener 6 also includes means 18 to secure the fastener 6 to a strap 20.

Figure 3:
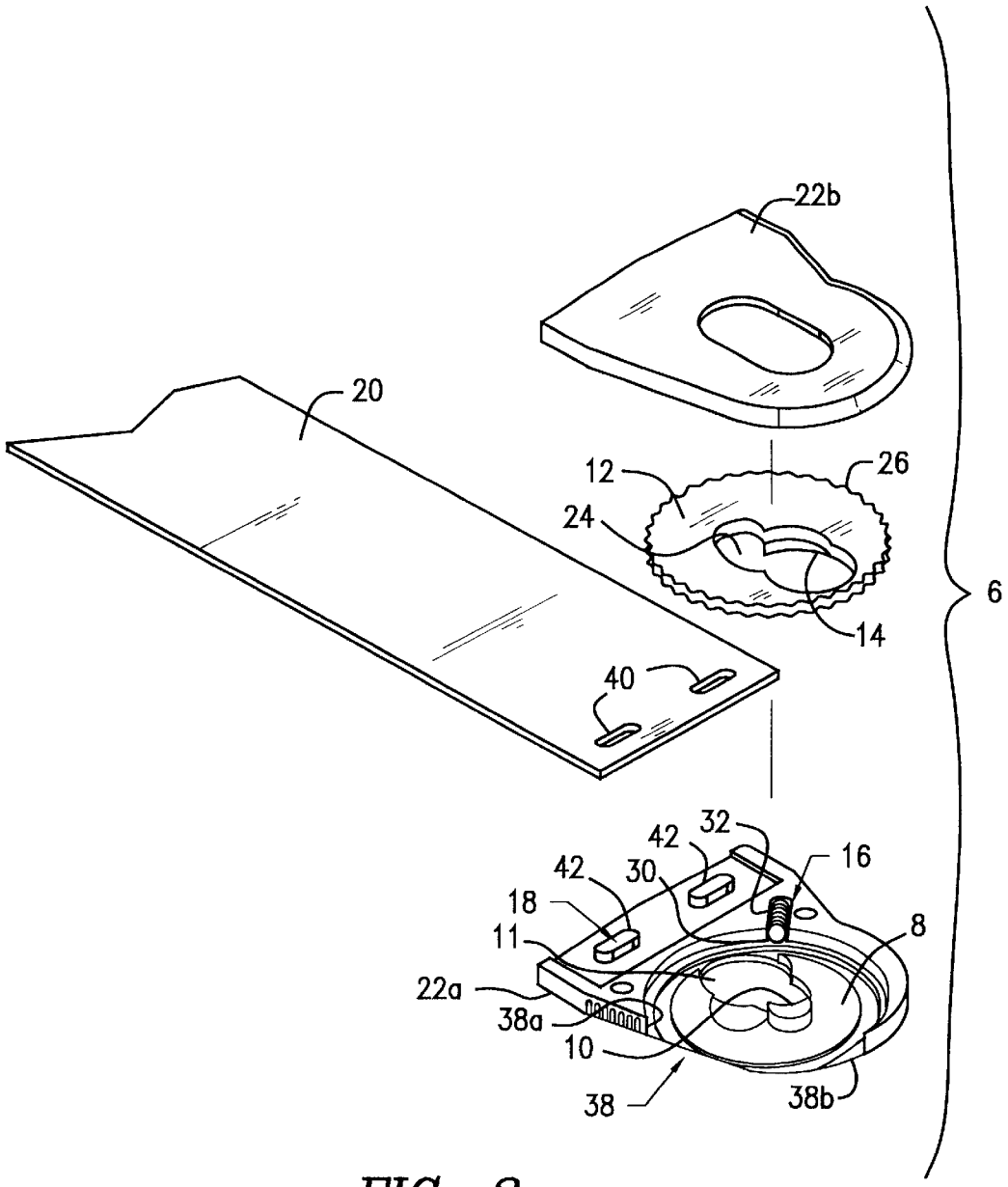
FIG. 3 is an exploded view of the preferred embodiment of the present invention having an integral attachment to the strap.
Figure 4:
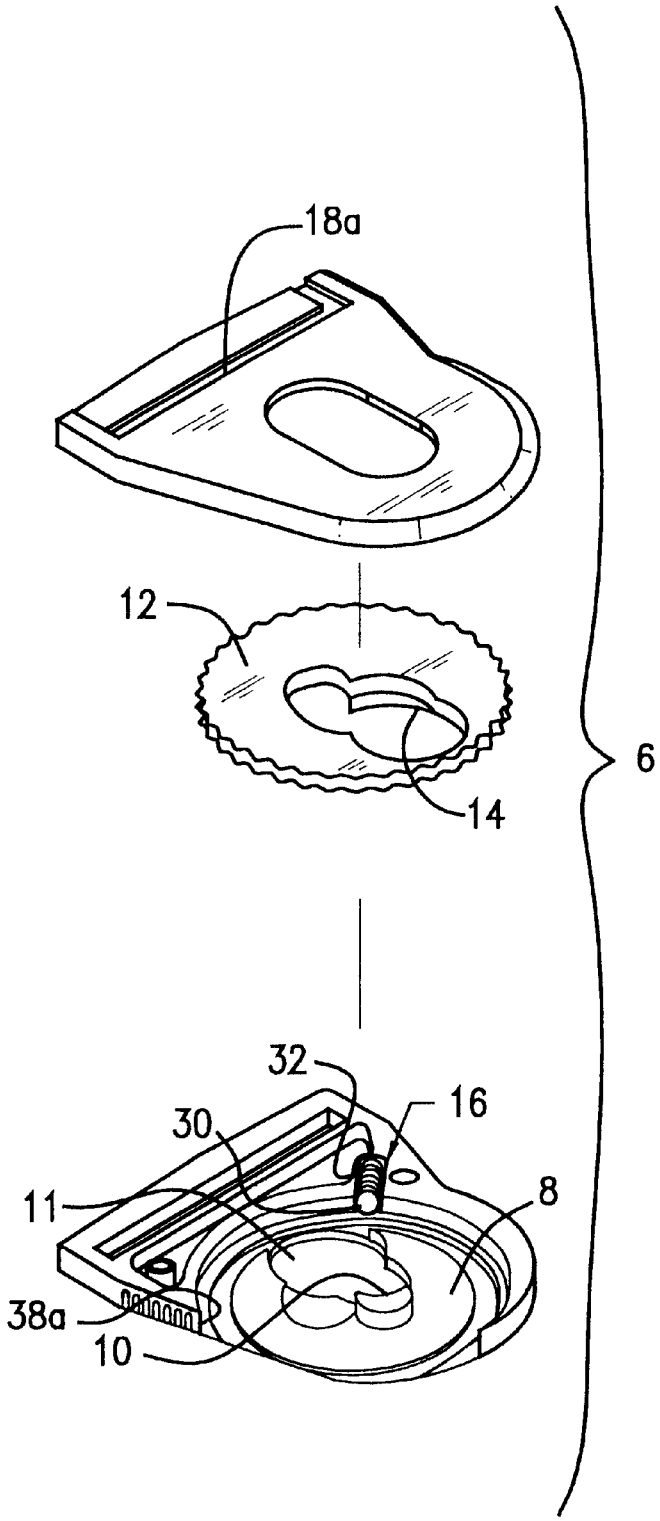
FIG. 4 is an exploded view of the preferred embodiment of the present invention having a loop attachment to the strap.

In its preferred embodiment, shown in FIGS. 3 and 4, the fastener 6 is comprised of a first member 8, shown incorporated into a bottom element portion 22*a*, an engaging member 12 and a top housing element 22*b*. The first member 8 has a rigid retention portion 10, shown as the perimeter of the aperture 11, against which the reduced diameter portion 4 of the end pin 2 will rest when the end pin 2 is engaged by the fastener 6.

In it most preferred embodiment, the engaging member 12 is a rotatable disk having an eccentric aperture 24 which also receives the end pin 2. The perimeter of the aperture 24 acts as the engagement portion 14 for limiting the aperture of the fastener 6 about the reduced diameter portion 4 of the end pin 2 when the engaging member 12 is rotated.

Preferably, the engagement portion 14 of the aperture 24 has a beveled edge to assist in the proper arrangement of the fastener aperture about the end pin 2. It is intended that when the engaging member 12 is rotated into its engagement position, the fastener aperture defined by the retention portion 10 of the first member 8 and the engagement portion 14 of the engaging member 12 is slightly larger than the reduced diameter portion 4 of end pin 2 but smaller than the terminal portion 28 of the end pin 2. Locking the engagement member 12 in its engagement position ensures that the fastener 6 cannot be removed from the end pin until the engaging member 12 is rotated so that the fastener aperture opens.

To aid rotation of the disk of the preferred engaging member 12, the disk has a scalloped outer edge 26. In the most preferred embodiment, the scalloped outer edge 26 also serves in the locking function, to lock the engagement member 12 in its engagement position. In this embodiment the locking element 16 for retaining the engaging member 12 in its engagement position comprises a ball 30 on the end of a spring 32. The concave portion of the scalloped edge 26 is a predetermined size to correspond with the ball 30 of the locking member 16 so that the ball 30 fits therein, retaining the engaging member 12 in a particular position.

In its most preferred embodiment, the scalloped outer edge has 36 equally spaced concave sites to allow the engaging member 12 to lock down in ten degree (10°) increments until the engagement portion 14 of the engaging member 12 contacts the reduced diameter portion 4 of the end pin 2.

It is also preferred that the engagement member 12 is enclosed in a housing so that the mechanism is protected from interference and the user avoids injury from exposed moving parts. The preferred housing has a bottom element 22*a* and a top element 22*b*. As shown in FIGS. 3 and 4, the bottom element 22*a* of the housing incorporates the first member 8 and accepts the engaging member 12, with the top housing element 22*b* covering the mechanism. The bottom element 22*a* is shown to include a lateral opening 38, defined by sides 38*a* and 38*b*, through which a portion of the scalloped outer edge 36 of the rotatable engaging element 12 can be manually activated by the user.

The strap 20 can be attached to the fastener 6 in any of a multitude of known ways, as well as additional ways which have not yet been developed, and the means for attachment are not intended to limit the present invention. The preferred means, however, include a fixed attachment means 18 as shown in FIG. 3 and a slidable attachment means 18*a* as shown in FIG. 4.

As shown in FIG. 3, the strap 20 is punched with two openings 40 for accepting two raised bosses 42 on the bottom element 22*a* of the housing. The top housing element 22*b* is then placed over the bottom element 22*a* which is retaining the strap end and is ultrasonically welded to provide a high strength attachment.

As shown in FIG. 4, the fastener 6 includes a slot 18*a* through which the strap 20 can be fed. The strap end is then sewn onto itself or secured onto an adjustment clip, as is known in the art, to provide for a length adjustment of the strap 20 according to the user's size and preference. As most preferred, one end of the strap of the present invention would include a fastener 6 with a fixed attachment 18 on one end and an adjustable attachment 18*a* on the other end.

The housing 22*a* and 22*b* of the preferred embodiment of the present invention is preferably molded of a plastic, and most preferably a high impact resistant plastic such as polycarbonate or acetal. The engaging member 12 is preferably made of a high impact resistant plastic such as acetal or nylon. Of course, the top element 22*b* of the housing can have an opening to view the engagement of the end pin, as shown, or can be closed for a finished look.

As discussed above, the fastener 6 of the present invention is intended to fasten a strap to any article which is adapted to include an end pin 2 having a reduced diameter portion 4 and a larger terminal portion 28. This includes luggage, portfolios, cases, packs, computers or computer cases, and the like as well as musical instruments.

Moreover, as described generally herein, the engaging member 12 can be formed in a linear as well as a radial fashion, as long as it serves to define a restrictive element which limits the size of the fastener aperture, as partially defined by the first member 8. Similarly, any locking mechanism for retaining the engaging member can be used, including but not limited to a ratchet means and catch/release mechanism or a latch over pressure plate, for example, which restricts movement of the engaging member when positioned in its engagement position.

Variations of the present invention will make themselves apparent to one skilled in the art who has reviewed the above description. All such variations are intended to fall within the spirit and scope of the present invention, limited only by the attached claims.

I claim:

1. A fastener for securing a strap onto an article to be supported, said article having an end pin thereon including a reduced diameter portion and a larger diameter terminal portion, said fastener comprising a first member having a retention portion for receiving the end pin, said retention portion defining a first portion of a fastener aperture, and an engaging member comprising a rotatable disk having an engagement portion defining a second portion of a fastener aperture so that rotation of the engaging member relative to the first member defines the size of the fastener aperture.

2. The fastener of claim 1 further comprising a locking mechanism for restricting movement of the engagement portion relative to the retention portion, thereby fixing the size of the fastener aperture.

3. The fastener of claim 2 wherein the outer edge of the rotatable disk is scalloped.

4. The fastener of claim 3 wherein the locking mechanism comprises a detent, said detent engaging concave elements of the scalloped edge of the disk.

5. The fastener of claim 3 wherein the scalloped outer edge has 36 concave elements equally spaced about the outer edge of the disk.

6. The fastener of claim 1 wherein the engagement portion comprises a perimeter of an eccentric aperture on the rotatable disk.

7. The fastener of claim 6 wherein the engagement portion comprises a beveled wall for facilitating engagement of the reduced diameter portion of the end pin.

8. The fastener of claim 1 further comprising means for attachment to a strap.

9. The fastener of claim 8 wherein the means for attachment comprises a slot in the fastener through which the strap passes.

10. The fastener of claim 8 wherein the means for attachment comprises one or more raised bosses corresponding to one or more holes in a terminal end of the strap.

11. The fastener of claim 10 wherein the housing comprises an opening for exposing at least a portion of the outer edge of the disk.

12. The fastener of claim 1 further comprising a housing.

* * * * *